US009583080B1

(12) United States Patent
Lai

(10) Patent No.: US 9,583,080 B1
(45) Date of Patent: Feb. 28, 2017

(54) ADJUSTABLE BEATER FOR A DRUM PEDAL

(71) Applicant: Mu-Sen Lai, Changhwa Hsien (TW)

(72) Inventor: Mu-Sen Lai, Changhwa Hsien (TW)

( * ) Notice: Subject to any disclaimer, the term of this patent is extended or adjusted under 35 U.S.C. 154(b) by 0 days.

(21) Appl. No.: 15/066,790

(22) Filed: Mar. 10, 2016

(51) Int. Cl.
*G10D 13/00* (2006.01)

(52) U.S. Cl.
CPC ..... *G10D 13/006* (2013.01)

(58) Field of Classification Search
CPC .... G10D 13/006; G10D 13/003; G10D 13/00; F16C 35/06
USPC ..... 84/422.1, 422.2, 422.3
See application file for complete search history.

(56) References Cited

U.S. PATENT DOCUMENTS 5,526,728 A * 6/1996 Behrenfeld ..... G10D 13/003 84/422.1

2014/0090543 A1* 4/2014 Kitching ..... G10D 13/006 84/422.1

* cited by examiner

*Primary Examiner* — Kimberly Lockett

(74) *Attorney, Agent, or Firm* — Birch, Stewart, Kolasch & Birch, LLP

(57) ABSTRACT

A beater for a drum pedal has a main body, a sleeve, a striking head, a distance adjusting unit, an inner fastening unit, an angular adjusting unit, a fastening set, and a stem. The sleeve is mounted around the main body. The striking head is mounted on the sleeve. The distance adjusting unit is mounted inside the main body. The inner fastening unit is mounted inside the distance adjusting unit. The angular adjusting unit is mounted through the distance adjusting unit and the inner fastening unit. The fastening set is connected to the inner fastening unit and abuts against the sleeve. The stem penetrates the sleeve, the main body, the inner fastening unit, and is connected to the angular adjusting unit. Operating the fastening set can tighten or loosen the inner fastening unit and adjust the distance adjusting unit and the angular adjusting unit.

9 Claims, 7 Drawing Sheets

ADJUSTABLE BEATER FOR A DRUM PEDAL

BACKGROUND OF THE INVENTION

1. Field of the Invention

The present invention relates to a drum pedal, and more particularly to a beater that can be adjusted in angle and distance between the striking head and the drumhead.

2. Description of Related Art

A drum pedal is a musical instrument for playing drums. With reference to FIG. 7, a conventional drum pedal 90 comprises a seat 91, two erect frames 92, a shaft 93, a driven block 94, a chain 95, a pedal 96, and a beater 97. The two erect frames 92 are mounted on the seat 91. Each erect frame 92 has an upper end away from the seat 91. The shaft 93 is rotatable and has two opposite ends. The two opposite ends of the shaft 93 are respectively mounted on the two upper ends of the two erect frames 92. The driven block 94 is mounted around the shaft 93. The chain 95 has a first end and a second end opposite the first end. The first end of the chain 95 is connected to the driven block 94. The pedal 96 has two opposite ends. One of the two opposite ends of the pedal 96 is pivotally mounted on the seat 91. The other opposite end of the pedal 96 is connected to the second end of the chain 95. The beater 97 is connected to the shaft 93 and has a striking head 971. A musician steps on the pedal 96 to pull the driven block 94 and drive the beater 97 sweeping to strike a drumhead of a drum. Since the beater 97 of the conventional drum pedal 90 lacks adjusting structures, the musician has to move the drum pedal 90 close to or away from the drum to adjust the distance between the striking head 971 and the drumhead. Therefore, the beater 97 of the conventional drum pedal 90 is inconvenient in use.

To overcome the shortcomings of the beater of the conventional drum pedal, the present invention provides an adjustable beater for a drum pedal to mitigate or obviate the aforementioned problems.

SUMMARY OF THE INVENTION

The main objective of the present invention is to provide an adjustable beater for a drum pedal that can be adjusted in the angle and distance between the striking head and the drumhead.

The beater comprises a main body, a sleeve, a striking head, a distance adjusting unit, an inner fastening unit, an angular adjusting unit, a fastening set, and a stem. The sleeve is mounted around the main body. The striking head is mounted on the sleeve. The distance adjusting unit is mounted inside the main body. The inner fastening unit is mounted inside the distance adjusting unit. The angular adjusting unit is mounted through the distance adjusting unit and the inner fastening unit. The fastening set is connected to the inner fastening unit and abuts against the sleeve. The stem penetrates the sleeve, the main body, the inner fastening unit, and is connected to the angular adjusting unit. Operating the fastening set can tighten or loosen the inner fastening unit and adjust the distance adjusting unit and the angular adjusting unit.

Other objects, advantages, and novel features of the invention will become more apparent from the following detailed description when taken in conjunction with the accompanying drawings.

DETAILED DESCRIPTION OF PREFERRED EMBODIMENT

Figure 1:
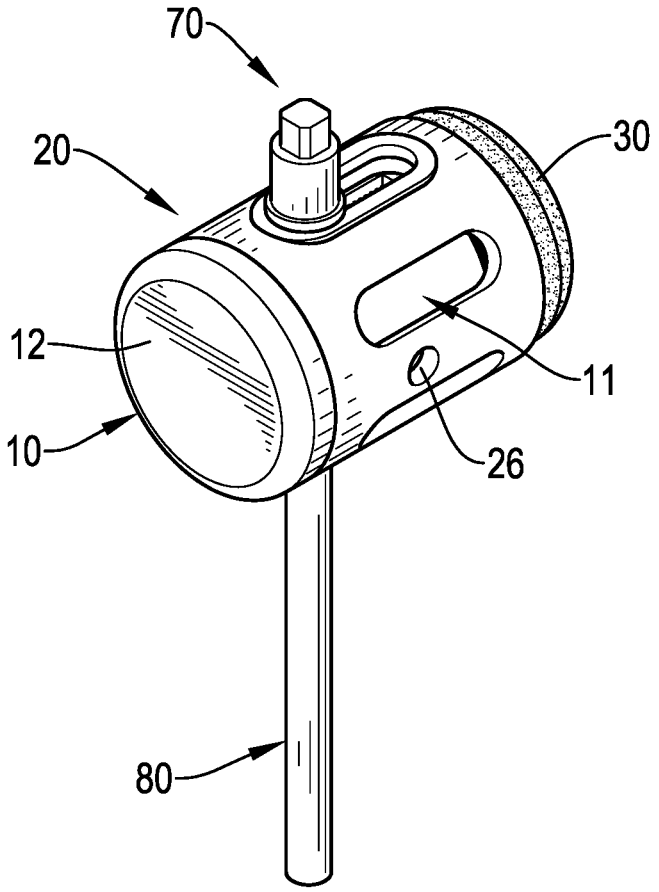
FIG. 1 is a perspective view of a beater in accordance with the present invention.
Figure 2:
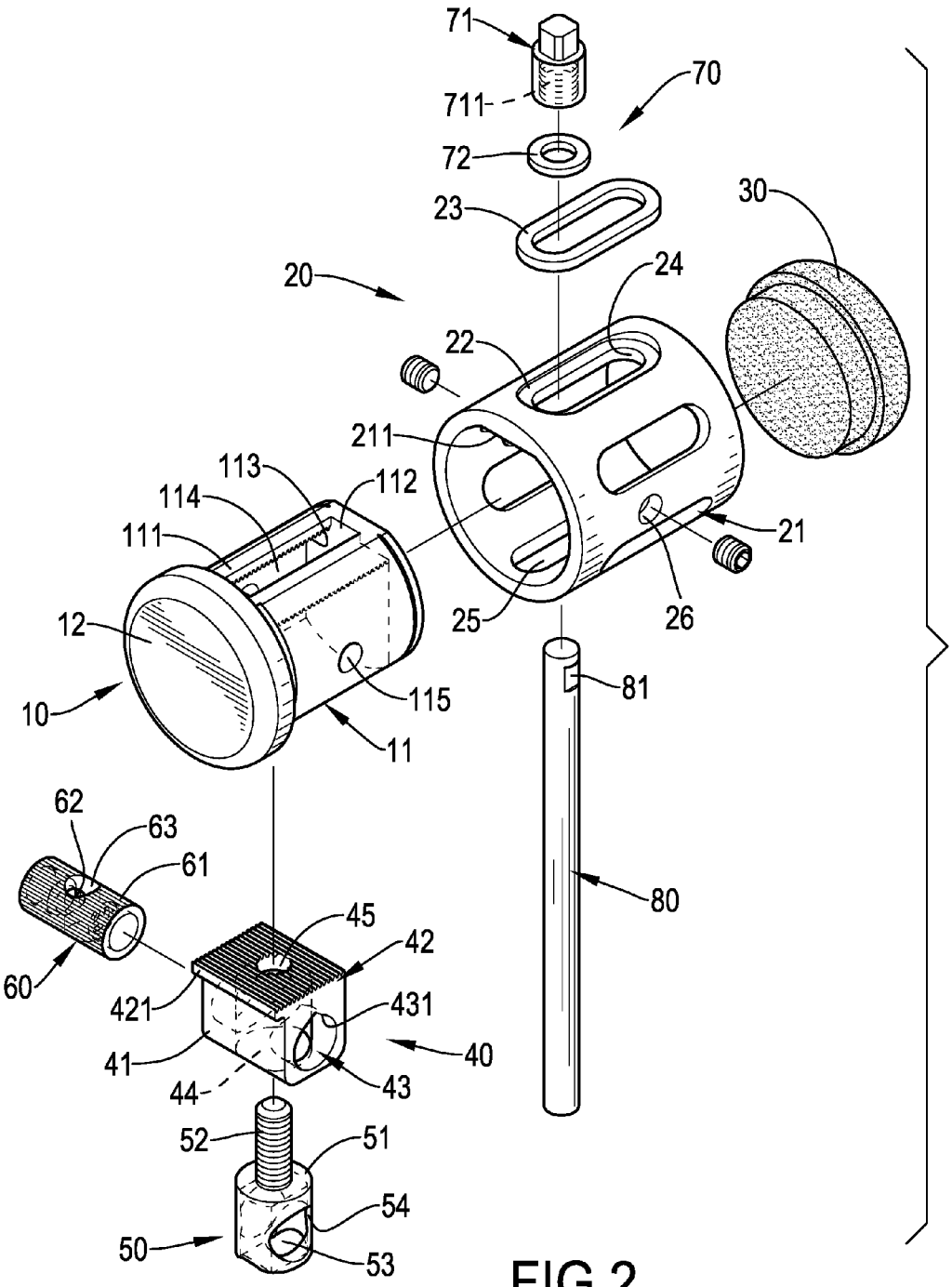
FIG. 2 is an exploded perspective view of the beater in FIG. 1.
Figure 3:
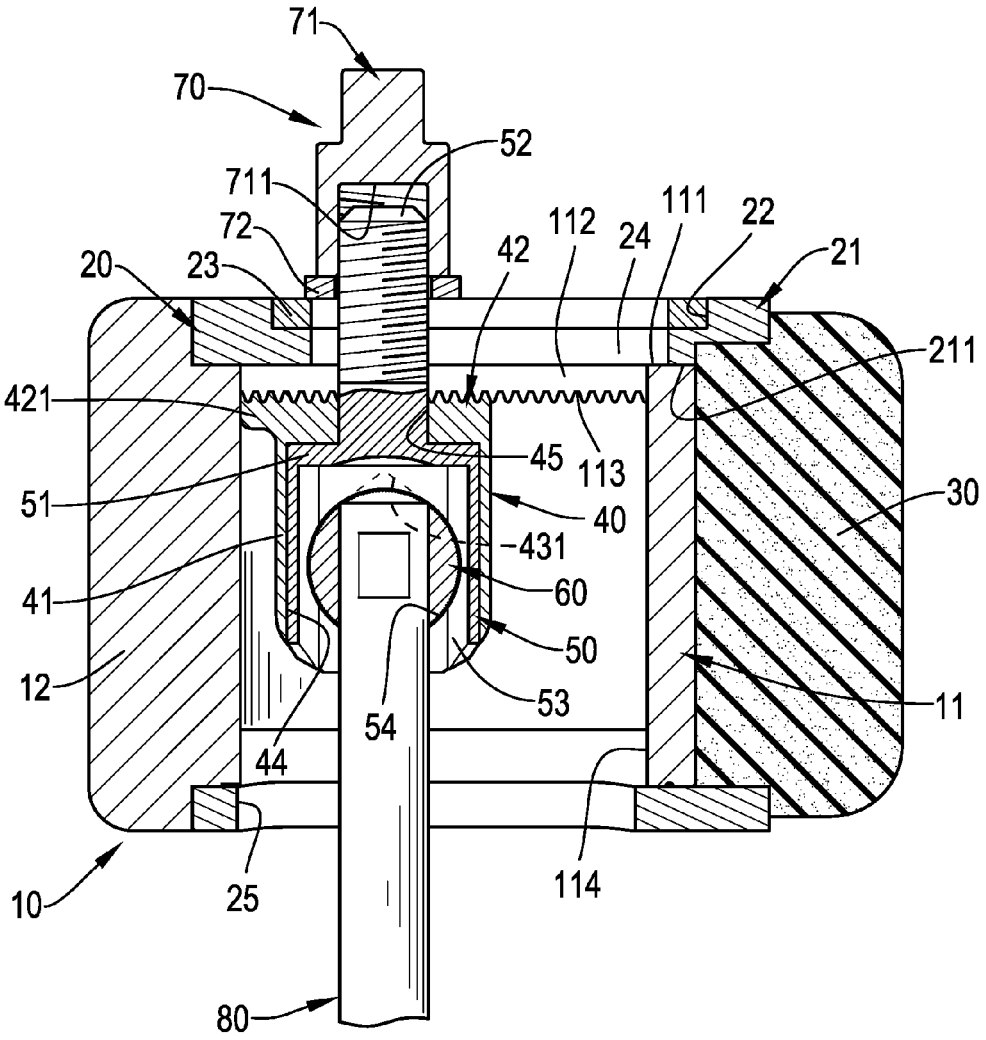
FIG. 3 is a side view in partial section of the beater in FIG. 1.

With reference to FIGS. 1, 2 and 3, a beater for a drum pedal in accordance with the present invention comprises a main body 10, a sleeve 20, a striking head 30, a distance adjusting unit 40, an inner fastening unit 50, an angular adjusting unit 60, a fastening set 70, and a stem 80. The sleeve 20 is mounted around the main body 10. The striking head 30 is mounted on the sleeve 20. The distance adjusting unit 40 is mounted inside the main body 10. The inner fastening unit 50 is mounted inside the distance adjusting unit 40. The angular adjusting unit 60 is mounted through the distance adjusting unit 40 and the inner fastening unit 50. The fastening set 70 is connected to the inner fastening unit 50 and abuts against the sleeve 20. The stem 80 penetrates the sleeve 20, the main body 10, the inner fastening unit 50, and is connected to the angular adjusting unit 60.

With reference to FIGS. 1, 2 and 3, the main body 10 has a mounting section 11 and a flange 12. The mounting section 11 is a hollow rod and has a longitudinal direction, a surrounding wall, a first abutting portion 111, an adjusting hole 112, a jagged face 113, an inserting hole 114, and two lateral holes 115. The surrounding wall may have a polygonal outline with a circumcircle or may be cylindrical. The first abutting portion 111 is formed on the surrounding wall of the mounting section 11 and has an outer face and an inner face. The outer face of the first abutting portion 111 is flat. The inner face of the first abutting portion 111 is opposite the outer face of the first abutting portion 111. The adjusting hole 112 is elongated and is radially defined through the first abutting portion 111. The adjusting hole 112 has an extending direction that is parallel to the longitudinal direction of the mounting section 11. The jagged face 113 is formed on the inner face of the first abutting portion 111. The inserting hole 114 is elongated and is radially defined through the surrounding wall of the mounting section 11. The inserting hole 114 is diametrically opposite the adjusting hole 112. The two lateral holes 115 are diametrically opposite each other and have an axial direction that is perpendicular to the extending direction of the adjusting hole 112. The adjusting hole 112, the inserting hole 114, and the two lateral holes 115 are disposed around the surrounding wall of the mounting section 11 at equal angular intervals.

With reference to FIGS. 1, 2 and 3, the sleeve 20 is a round tube and is mounted around the mounting section 11 of the main body 10. The sleeve 20 has a peripheral wall 21, a recess 22, a pad 23, a through hole 24, an assembling hole 25, and two side holes 26. The peripheral wall 21 may have a polygonal outline with a circumcircle or may be cylindrical. The peripheral wall 21 has two opposite ends, an inner surface, and a second abutting portion 211 formed on the inner surface of the peripheral wall 21. The second abutting portion 211 is flat and abuts the first abutting portion 111 of the mounting section 11. The recess 22 is radially defined in the peripheral wall 21 and extends toward the second abutting portion 211. The pad 23 is annular and is mounted in the recess 22. The through hole 24 is elongated and is radially defined through the second abutting portion 211 and communicates with the recess 22. The assembling hole 25 is elongated as well and is radially defined through the peripheral wall 21. The through hole 24 and the assembling hole 25 are diametrically opposite each other. The two side holes 26 are diametrically opposite each other and have an axial direction parallel to the axial direction of the two lateral holes 115 of the mounting section 11. Each side hole 26 is radially defined in the peripheral wall 21.

With reference to FIGS. 1, 2 and 3, the striking head 30 is mounted at one of the two opposite ends of the peripheral wall 21.

With reference to FIGS. 1, 2 and 3, the distance adjusting unit 40 is mounted inside the mounting section 11 of the main body 10. The distance adjusting unit 40 has a distance adjusting body 41, an anti-slip portion 42, a containing hole 43, a receiving hole 44, and an upper hole 45. The distance adjusting body 41 is a block and has a longitudinal direction, an upper end, and a lower end. The longitudinal direction of the distance adjusting body 41 is perpendicular to the longitudinal direction of the mounting section 11 and is parallel to the axial direction of the two lateral holes 115 of the mounting section 11. The anti-slip portion 42 is formed on the upper end of the distance adjusting body 41 and has a serrated face engaged with the jagged face of the mounting section 11. The anti-slip portion 42 is wider than the distance adjusting body 41 and forms a protruding portion 421 heading to the flange 12 of the main body 10. The containing hole 43 is longitudinally defined through the distance adjusting body 41 and has a cavity 431. The cavity 431 is formed in an inner surface of the containing hole 43 and has a tip pointing to the anti-slip portion 42. The receiving hole 44 is defined in the lower end of the distance adjusting body 41 and extends toward the upper end of the distance adjusting body 41. The receiving hole 44 has a diameter. The upper hole 45 is defined through the serrated face of the anti-slip portion 42 at the upper end of the distance adjusting body 41. The upper hole 45 communicates with the receiving hole 44.

With reference to FIGS. 1, 2 and 3, the inner fastening unit 50 has an abutting section 51, a fixing section 52, an activating hole 53, and a penetrating hole 54. The abutting section 51 is a round rod and is mounted in the receiving hole 44 of the distance adjusting unit 40. The abutting section 51 may have a polygonal outline with a circumcircle or may be cylindrical. The abutting section 51 has two opposite ends. The fixing section 52 is axially connected to one of the two opposite ends of the abutting section 51 and extends through the upper hole 45 of the distance adjusting unit 40. The fixing section 52 has a peripheral surface and a thread formed on the peripheral surface of the fixing section 52. The activating hole 53 is defined in the other opposite end of the abutting section 51 and extends toward the fixing section 52. The penetrating hole 54 is diametrically defined through the abutting section 51 and communicates with the activating hole 53 and the containing hole 43 of the distance adjusting unit 40.

With reference to FIGS. 1, 2 and 3, the angular adjusting unit 60 is mounted in the containing hole 43 of the distance adjusting unit 40 and the penetrating hole 54 of the inner fastening unit 50. The angular adjusting unit 60 is cylindrical and has a peripheral surface, two opposite ends, multiple grooves 61, a central hole 62, and a connecting hole 63. The multiple grooves 61 are formed in the peripheral surface of the angular adjusting unit 60 and extend to the two ends of the angular adjusting unit 60. The central hole 62 is axially defined in the angular adjusting unit 60. The central hole 62 has an inner surface and a thread formed on the inner surface of the central hole 62. The connecting hole 63 is diametrically defined through a middle portion of the angular adjusting unit 60.

With reference to FIGS. 1, 2 and 3, the fastening set 70 is disposed outside the sleeve 20 and is mounted on the fixing section 52 of the inner fastening unit 50. The fastening set 70 has an outer fastening unit 71 and a washer 72. The outer fastening unit 71 has a fastening hole 711 axially defined in the outer fastening unit 71. The fastening hole 711 has an inner surface and a thread formed on the inner surface of the fastening hole 711. The outer fastening unit 71 is screwed with the fixing section 52. The washer 72 is mounted around the fixing section 52 and abuts against both the outer fastening unit 71 and the pad 23 of the sleeve 20.

With reference to FIGS. 1, 2 and 3, the stem 80 is mounted in the connecting hole 63 of the angular adjusting unit 60. The stem 80 has a peripheral surface, two opposite ends, and two abutting faces 81. The two abutting faces 81 are adjacent to one of the two opposite ends of the stem 80 and are diametrically opposite each other. Each abutting face 81 is defined in the peripheral surface of the stem 80. Two set screws respectively penetrate through the two side holes 26 of the sleeve 20 and the two lateral holes 115 of the mounting section 11, and are screwed in the central hole 62 of the angular adjusting unit 60. The two set screws respectively abut against the two abutting faces 81. In an alternative connecting way, the stem 80 may be screwed in the connecting hole 63 of the angular adjusting unit 60. The connecting hole 63 of the angular adjusting unit 60 may have a thread formed on an inner surface of the connecting hole 63. The stem 80 may have a threaded portion disposed at one of the two opposite ends of the stem 80.

Figure 4:
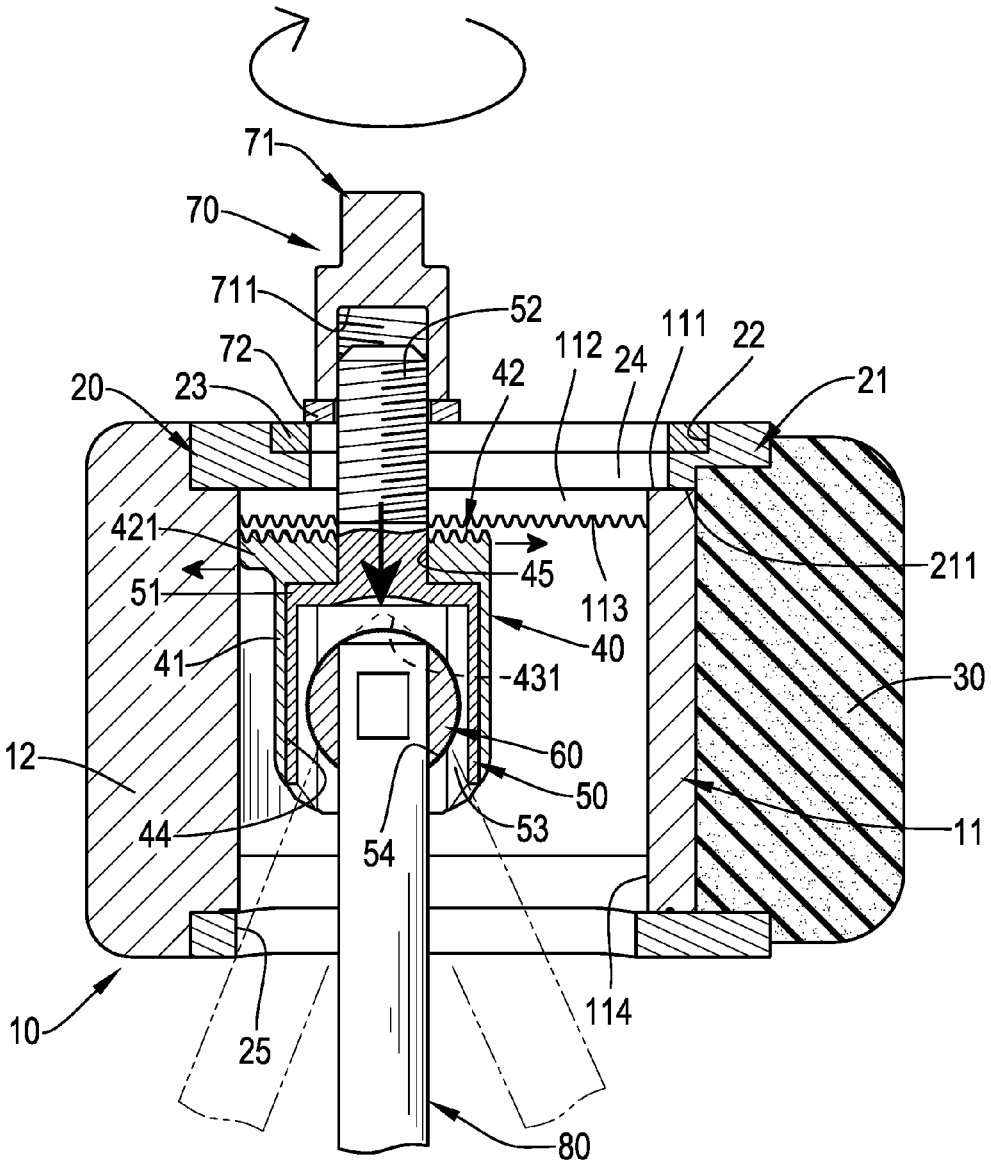
FIG. 4 is an operational side view in partial section of the beater in FIG. 1.

With reference to FIG. 4, to loosen the outer fastening unit 71 and detach the outer fastening unit 71 from an abutting position can make the distance adjusting unit 40, the inner fastening unit 50, the angular adjusting unit 60, and the stem 80 move downward due to the weight. The serrated face of the anti-slip portion 42 of the distance adjusting unit 40 is disengaged from the jagged face 113 of the mounting section 11. The distance adjusting unit 40 thereby can move toward the flange 12 of the main body 10 or toward the striking head 30 to adjust the distance between the striking head 30 and a drumhead of a drum. At the same time, the angular adjusting unit 60 can rotate in the containing hole 43 of the distance adjusting unit 40 and the stem 80 connected to the angular adjusting unit 60 can sweep to adjust the angle between the striking head 30 and the drum head.

Figure 5:
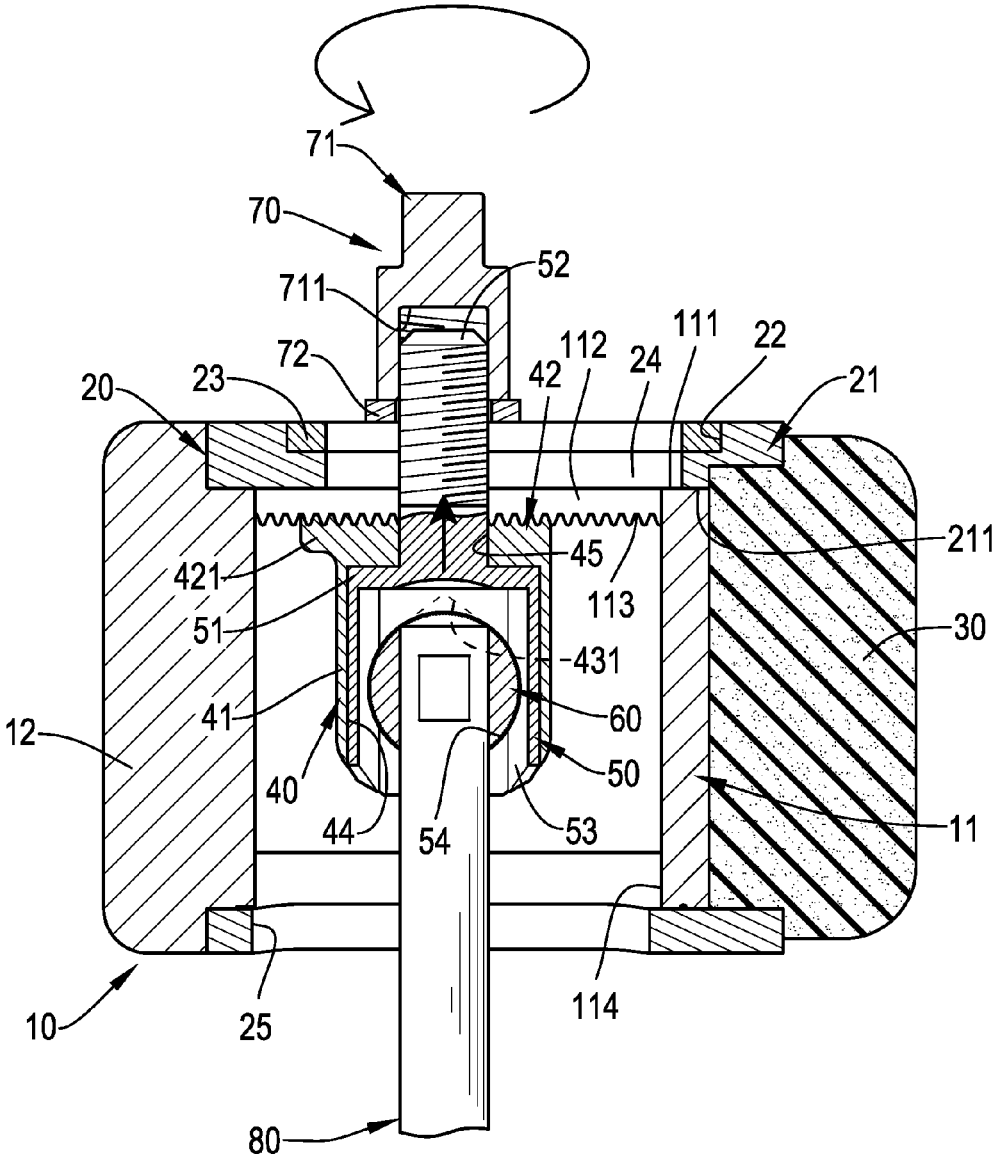
FIG. 5 is another operational side view in partial section of the beater in FIG. 1.
Figure 6:
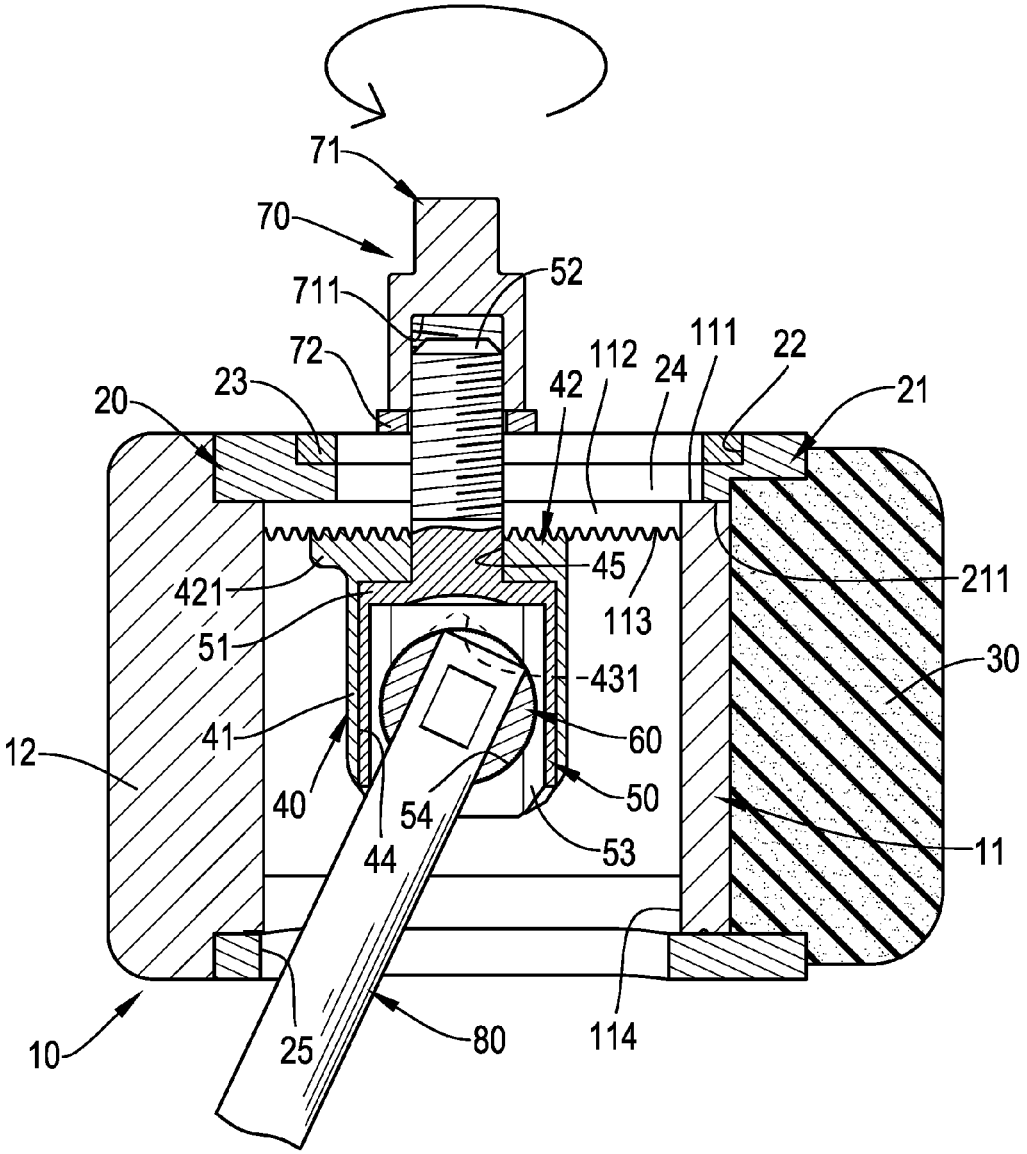
FIG. 6 is another operational side view in partial section of the beater in FIG. 1.
Figure 7:
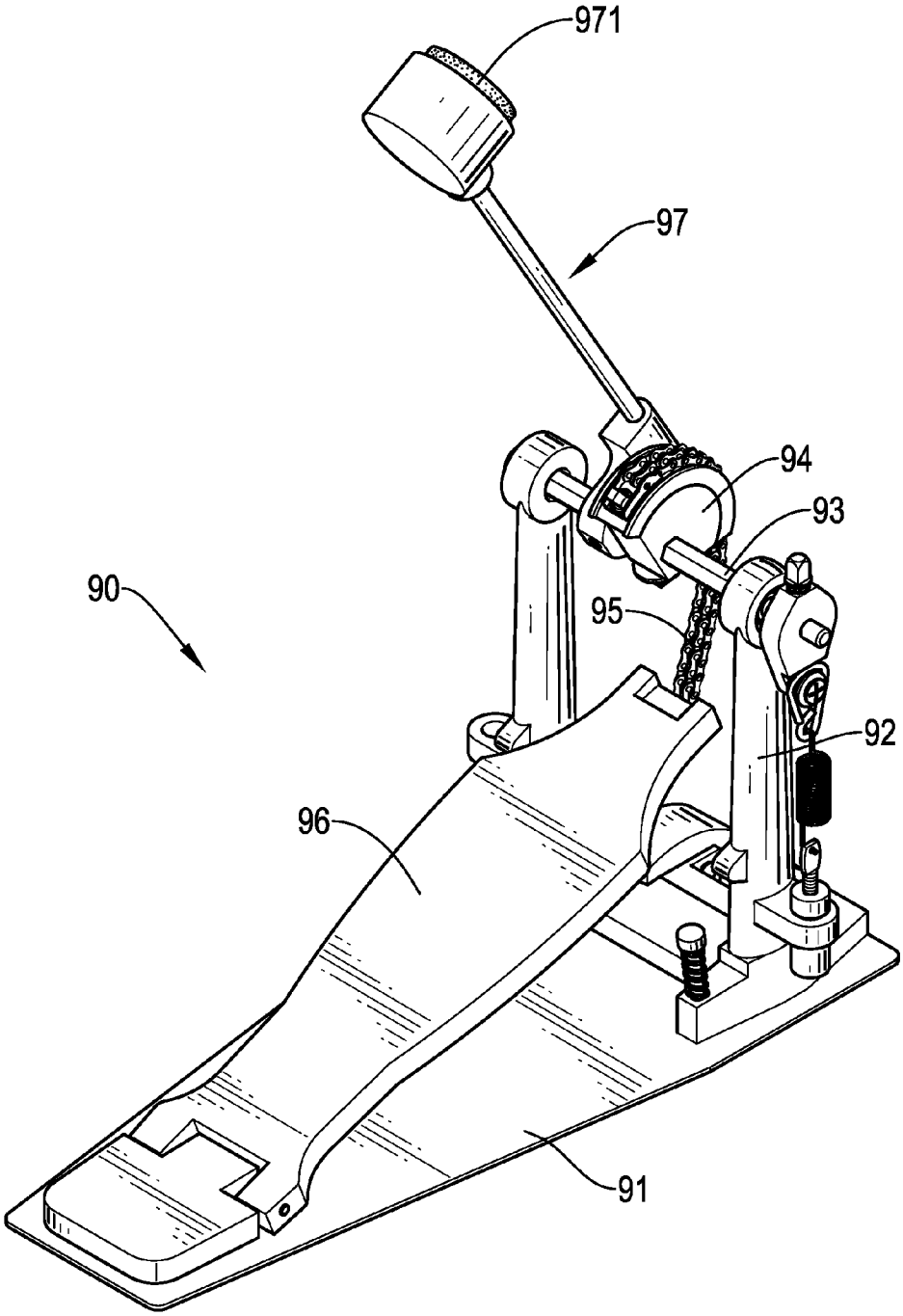
FIG.7 PRIOR ART
FIG. 7 is a perspective view of a conventional drum pedal.

With reference to FIGS. 5 and 6, when the adjustment is finished, screwing the outer fastening unit 71 tightly can pull the inner fastening unit 50 and make the anti-slip portion 42 abut against the first abutting portion 111 of the mounting section 11. The serrated face of the anti-slip portion 42 engages with the jagged face 113 of the mounting section 11 to reduce the chance of sliding between the main body 10 and the distance adjusting unit 40. The angular adjusting unit 60 is pulled by the inner fastening unit 50 and abuts against the containing hole 43 of the distance adjusting unit 40. The cavity 431 of the containing hole 43 can engage the angular adjusting unit 60, prevent the angular adjusting unit 60 from rotating in the containing hole 43, and keep the suitable angle between the striking head 30 and the drumhead. The multiple grooves 61 of the angular adjusting unit 60 also can prevent the angular adjusting unit 60 from rotating unintentionally.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A beater comprising:

a main body having a mounting section being hollow and having a longitudinal direction;

a surrounding wall;

a first abutting portion formed on the surrounding wall of the mounting section;

an adjusting hole being elongated and defined through the first abutting portion, the adjusting hole having an extending direction; and an inserting hole being elongated and diametrically defined through the surrounding wall of the mounting section, the inserting hole being elongated and diametrically opposite the adjusting hole;

a sleeve mounted around the mounting section and having a peripheral wall having two opposite ends;

an inner surface; and a second abutting portion formed on the inner surface of the peripheral wall and abutting against the first abutting portion;

a through hole being elongated and defined through the second abutting portion and communicating with the adjusting hole of the main body; and an assembling hole being elongated and defined through the peripheral wall, the assembling hole diametrically opposite the through hole and communicating with the inserting hole of the main body;

a striking head mounted at one of the two opposite ends of the peripheral wall;

a distance adjusting unit mounted inside the mounting section of the main body and abutting against the first abutting portion of the mounting section, and the distance adjusting unit having a distance adjusting body having a longitudinal direction that is perpendicular to the extending direction of the adjusting hole;

an upper end; and a lower end opposite the upper end of the distance adjusting body;

a containing hole longitudinally defined through the distance adjusting body;

a receiving hole defined in the lower end of the distance adjusting body and extending toward the upper end of the distance adjusting body; and an upper hole defined through the upper end of the distance adjusting body and communicating with the receiving hole;

an inner fastening unit having an abutting section mounted in the receiving hole of the distance adjusting unit and having two opposite ends;

a fixing section connected to one of the two opposite ends of the abutting section and extending through the upper hole of the distance adjusting unit, the adjusting hole of the mounting section, and the through hole of the sleeve;

an activating hole defined in the other opposite end of the abutting section and extending toward the fixing section; and a penetrating hole diametrically defined through the abutting section, the penetrating hole communicating with the activating hole and the containing hole of the distance adjusting unit;

an angular adjusting unit mounted in the containing hole of the distance adjusting unit and the penetrating hole of the inner fastening unit, the angular adjusting unit being cylindrical and abutting against the containing hole;

a fastening set disposed outside the sleeve, mounted on the fixing section, and abutting against the sleeve; and a stem mounted through the assembling hole of the sleeve, the inserting hole of the mounting section, and the activating hole of the inner fastening unit and connected to the angular adjusting unit.

2. The beater as claimed in claim 1, wherein the first abutting portion of the mounting section has an inner face;

the mounting section has a jagged face formed on the inner face of the first abutting portion; and the distance adjusting unit has an anti-slip portion formed on the upper end of the distance adjusting body of the distance adjusting unit, and the anti-slip portion has a serrated face engaged with the jagged face of the mounting section.

3. The beater as claimed in claim 2, wherein the angular adjusting unit has a peripheral surface;

two opposite ends; and multiple grooves formed in the peripheral surface of the angular adjusting unit and extending to the two opposite ends of the angular adjusting unit.

4. The beater as claimed in claim 3, wherein the containing hole of the distance adjusting unit has a cavity formed in an inner surface of the containing hole, and the cavity has a tip pointing to the anti-slip portion; and the angular adjusting unit engages the cavity.

5. The beater as claimed in claim 4, wherein the mounting section has two lateral holes being diametrically opposite each other and having an axial direction parallel to the longitudinal direction of the distance adjusting body, each lateral hole radially defined in the surrounding wall of the mounting section;

the sleeve has two side holes being diametrically opposite each other and having an axial direction parallel to the longitudinal direction of the distance adjusting body, each side hole radially defined in the peripheral wall of the sleeve;

the angular adjusting unit has a central hole axially defined in the angular adjusting unit; and a connecting hole diametrically defined through the angular adjusting unit; and the stem is mounted in the connecting hole and has a peripheral surface;

two opposite ends; and two abutting faces being adjacent to one of the two opposite ends of the stem and being diametrically opposite each other, the two abutting faces defined in the peripheral surface of the stem and respectively abutted against by two set screws screwed in the central hole of the angular adjusting unit.

6. The beater as claimed in claim 5, wherein the peripheral wall of the sleeve has an outer surface;

the sleeve has a recess radially formed in the outer surface of the peripheral wall and communicating with the through hole of the sleeve;

the recess is disposed in a pad which is annular;

the fastening set has an outer fastening unit screwed with the fixing section of the inner fastening unit; and a washer mounted around the fixing section of the inner fastening unit and abutting against both the outer fastening unit and the pad.

7. The beater as claimed in claim 6, wherein the mounting section of the main body has two opposite ends in the longitudinal direction of the mounting section;

the main body has a flange connected to one of the two opposite ends of the mounting section; and one of the two ends of the peripheral wall that is opposite the striking head abuts against the flange.

8. The beater as claimed in claim 4, wherein the anti-slip portion of the distance adjusting unit is wider than the distance adjusting body of the distance adjusting unit and forms a protruding portion heading to the flange of the main body.

9. The beater as claimed in claim 4, wherein the angular adjusting unit has a connecting hole radially defined in the angular adjusting unit; and the stem is screwed in the connecting hole.

* * * * *